United States Patent [19]

Stitzer et al.

[11] Patent Number: 4,980,657

[45] Date of Patent: Dec. 25, 1990

[54] COPLANAR WAVEGUIDE FREQUENCY SELECTIVE LIMITER

[75] Inventors: Steven N. Stitzer, Ellicott City, Md.; John D. Adam, Murrysville, Pa.

[73] Assignee: Westinghouse Electric Corp., Pittsburgh, Pa.

[21] Appl. No.: 414,877

[22] Filed: Sep. 29, 1989

[51] Int. Cl.[5] ..... H01P 1/218; H01P 1/23

[52] U.S. Cl. ..... 333/17.2; 333/24.2

[58] Field of Search ..... 333/17.2, 24.1–24.3, 333/1.1

[56] References Cited

U.S. PATENT DOCUMENTS

| | | | |
|---|---|---|---|
| 3,602,845 | 8/1971 | Agrios et al. | 333/24.1 |
| 4,005,375 | 1/1976 | Pringle et al. . | |
| 4,044,357 | 8/1977 | Goldie . | |
| 4,152,676 | 5/1979 | Morgenthaler et al. | 333/24.1 |
| 4,155,053 | 5/1979 | Stitzer et al. . | |
| 4,251,786 | 2/1981 | Goldie et al. . | |
| 4,283,692 | 8/1981 | Adam | 333/17.2 |
| 4,325,140 | 4/1982 | Stitzer . | |
| 4,488,122 | 12/1984 | Wolkstein . | |
| 4,595,889 | 6/1986 | Stitzer et al. | 333/17.2 |
| 4,642,584 | 2/1987 | Funck et al. . | |
| 4,675,682 | 6/1987 | Adam et al. . | |
| 4,754,243 | 6/1988 | Armstrong et al. . | |

*Primary Examiner*—Paul Gensler

*Attorney, Agent, or Firm*—W. G. Sutcliff

[57] ABSTRACT

A frequency selective limiting device is described incorporating a planar ferrite member and at least one signal-carrying conductor positioned thereon. A conductor is located on the ferrite member to confine a portion of an RF magnetic field produced by the microwave signals within the ferrite member. In one embodiment of the invention, the conductor comprises coplanar ground planes positioned adjacent to the signal-carrying conductor, thereby forming a coplanar waveguide. Alternatively a pair of coplanar conductors may form a slot line. In another embodiment a second ferrite member is positioned in confronting relationship with the first ferrite member carrying the conductors.

15 Claims, 4 Drawing Sheets

COPLANAR WAVEGUIDE FREQUENCY SELECTIVE LIMITER

BACKGROUND OF THE INVENTION

1. Field of the Invention

This invention relates to attenuating devices, and more particularly, to devices which utilize a YIG material to provide frequency selective attenuation of microwave signals above a preselected threshold power level.

2. Description of the Related Art

Frequency selective limiting (FSL) or attenuating devices which utilize a yttrium-iron-garnet (YIG) material have the property of being able to attenuate higher power level signals while simultaneously allowing lower power level signals, separated by only a small frequency offset from the higher level signals, to pass with relatively low loss. YIG-based FSLs are capable of limiting or attenuating across more than an octave bandwidth in the 2–8 GHz range. Higher power level (above-threshold) signals within this bandwidth will be attenuated without requiring tuning of the FSL. Lower power level (below-threshold) signals, separated from the higher power level signals by more than a few spin-wave linewidths, will pass through the FSL without experiencing any greater loss than if the higher power level signals were not present. For an attenuating device based on YIG, this selectivity bandwidth is on the order of between 20–50 MHz.

YIG-based FSLs have many applications in microwave signal systems. One such application is illustrated in FIG. 1. The microwave signal system 10 includes an antenna 12 for collecting and passing microwave RF signals, a YIG-based FSL device 16 and a broadband receiver 14 (hereafter sometimes referred to as receiver 14). Microwave signal processing equipment 18 is responsive to the output of the receiver 14. The microwave signal processing equipment 18 is of a type presently known in the art and will not be further described.

FSL 16 is utilized to increase the dynamic range over which microwave signals collected by the antenna 12 can be accepted by the receiver 14. Because known receivers such as broadband receiver 14 generally have a dynamic range of approximately 35 dB, and signals of interest arriving at antenna 12 may have a dynamic range of, for example, 85 dB, it can be readily appreciated that a power mismatch is created within system 10. The mismatch is corrected by utilizing the FSL device 16 which may be designed to provide a dynamic range of about 50 dB, to make up the difference between the signal level at the antenna 12 and the dynamic range of the receiver 14.

FSL 16 is designed to provide that the ratio of power out to power in ($P_{out}/P_{in}$), below a predetermined threshold value of $TP_{in}$, is substantially linear. As the value of input power $P_{in}$ seen by FSL 16 increases above the predetermined threshold value of $TP_{in}$, the ratio of $P_{out}/P_{in}$ becomes smaller. Stated in another manner, FSL device 16 operates to attenuate an above threshold, high power input microwave signal having a large dynamic range to provide an output signal having a smaller dynamic range.

A YIG-based frequency selective limiting (FSL) device 20 discussed in copending U.S. patent application entitled "Frequency Selective Limiting Device," Ser. No. 07/169,926 filed Mar. 18, 1988 in the name of Steven N. Stitzer et al. U.S. Pat. No. 4,845,439 which was issued July 4, 1989 and assigned to Westinghouse Electric Company the assignee of the present invention is illustrated in FIGS. 2A and 2B. Attenuation in the FSL 20 is proportional to the volume of YIG material in layers 22 and 24 which is coupled to the RF magnetic-field 26 generated by the signal-carrying conductor 28. While the configuration and positioning of the YIG layers 22 and 24 relative to the signal-carrying conductor 28 results in satisfactory coupling of the RF magnetic field 26 with YIG material layers 22 and 24, the configuration of the FSL 20 is difficult and expensive to fabricate.

According to current manufacturing procedures a narrow signal-carrying conductor 28 is sandwiched between two thin layers 22 and 24 of single crystal yttrium-iron-garnet (YIG). The YIG layers are typically about 0.002 to 0.005 inch thick. Effective limiting requires a strong coupling of RF magnetic-field 26 with the YIG for a given RF power level. Accordingly, in order to confine the magnetic-field 26 within the YIG layers 22 and 24, the sandwich is surrounded by a ground plane 29 formed by metallized layers 32 and 36. The arrangement of FIGS. 2A and 2B ensures that substantially all the RF field lines 26 pass through the YIG layers 22 and 24.

The device 20 is currently made by epitaxially forming separately, each YIG layer, 22 and 24, as a thin layer of single crystal YIG on a gadolinium-galliumgarnet (GGG) substrate (not shown). Each layer of GGG is then removed by a grinding step. It is also necessary to use a separate GGG metalized substrate 30 as a device support. The metalized surface 32 separates the GGG substrate 30 from the YIG material 24. The current process is expensive and time consuming.

SUMMARY OF THE INVENTION

The present invention simplifies the configuration and fabrication process of FSL devices for attenuating microwave signals above a preselected power level passed therethrough. According to the present invention, a signal-carrying conductor is positioned on a planar ferrite member for carrying microwave signals on an axis substantially parallel to the planar ferrite member. A conductive confining means is located on the ferrite member to confine a portion of an RF magnetic field produced by the microwave signals within the ferrite member. The ferrite member, in conjunction with the conductive confining means, is operable to attenuate, by predetermined level, microwave signals above a preselected threshold power level carried by the signal-carrying conductor. Attenuation of microwave signals having a power level below the threshold power level is substantially zero.

Another embodiment of the invention includes a second generally planar ferrite member positioned on the signal-carrying conductor and the conductive confining means in confronting relationship with the first ferrite member to further enhance the attenuation of the microwave signals. The conductive confining means and the signal-carrying conductor, in this alternate embodiment, form a transverse electromagnetic (TEM) transmission line such as coplanar waveguide or the conductive confining means may be a slot line.

The conductive confining means may be comprised of a pair of coplanar ground planes which are in parallel, laterally spaced relationship with the signal-carrying conductor.

DESCRIPTION OF THE PREFERRED EMBODIMENTS

The theory of operation and the construction of frequency selective limiting (FSL) devices which utilize a yttrium-iron-garnet (YIG) material are described in the following articles, which are incorporated by reference herein: "Frequency Selective Microwave Power Limiting in Thin YIG Films," *IEEE Transactions on Magnetics*, Vol. MAG-19, No. 5, September 1983, Steven N. Stitzer; "A Multi-Octave Frequency Selective Limiter," 1983 *IEEE MTT-S Digest*, page 326, Steven N. Stitzer and Harry Goldie; "Non-Linear Microwave Signal-Processing Devices Using Thin Ferromagnetic Films," *Circuits, Systems, and Signal Processing*, Vol. 4, No. 1–2, 1985, page 227, Steven N. Stitzer and Peter R. Emtage.

Figure 1:
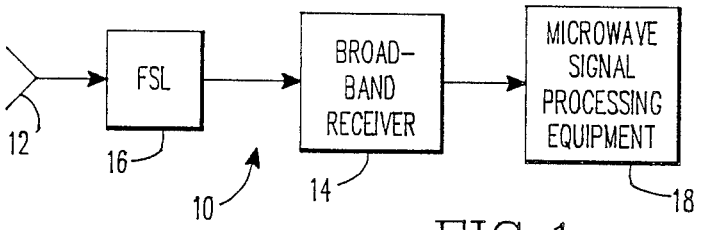
FIG. 1 is a schematic block diagram of a microwave circuit in which the frequency selective limiting device of the present invention may be utilized.
Figure 2A:
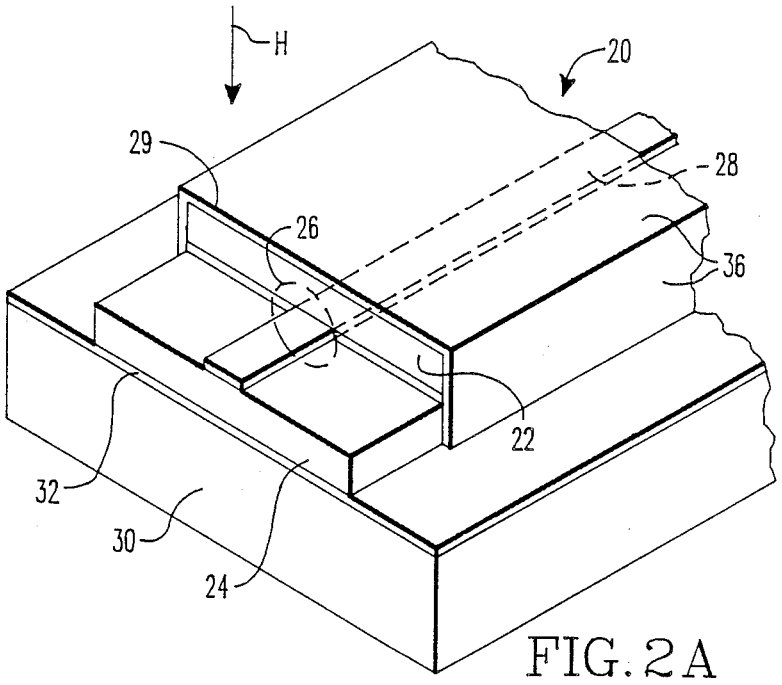
FIG. 2A is a fragmentary perspective view of a frequency selective limiting device disclosed in the above identified copending U.S. patent application assigned to the assignee of the present application.
Figure 2B:
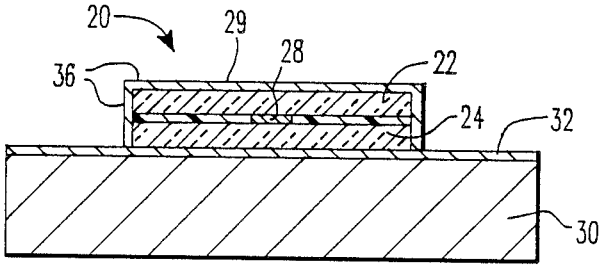
FIG. 2B is a side sectional view of the FSL device of FIG. 2A.
Figure 3:
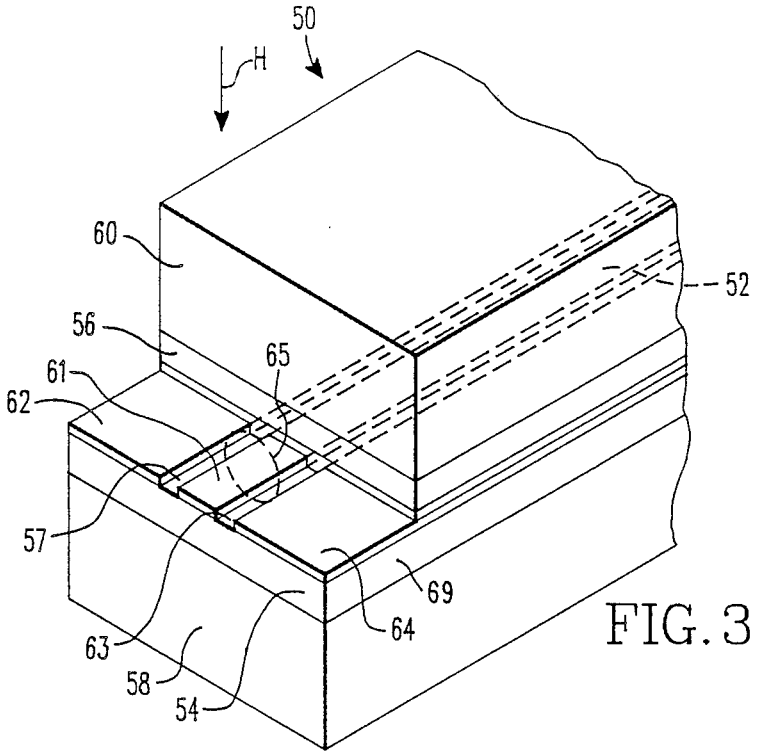
FIG. 3 is a fragmentary perspective view of a frequency selective limiting device according to the present invention.
Figure 4A:
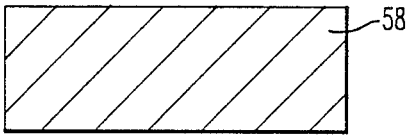
FIGS. 4A through 4E illustrate in a series of side sectional views the sequence of steps for assembling the FSL device of FIG. 3.
Figure 4B:
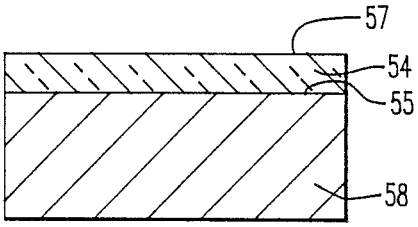
Figure 4C:
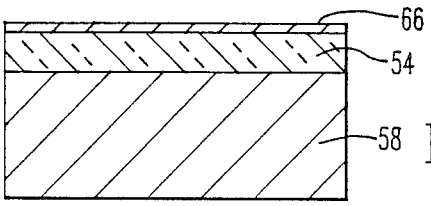
Figure 4D:
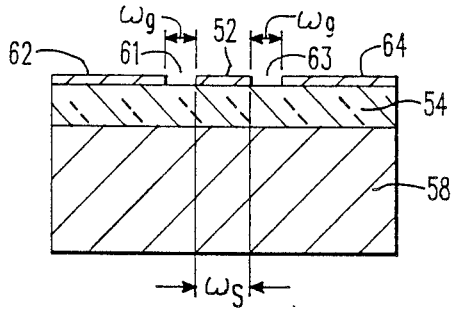
Figure 4E:
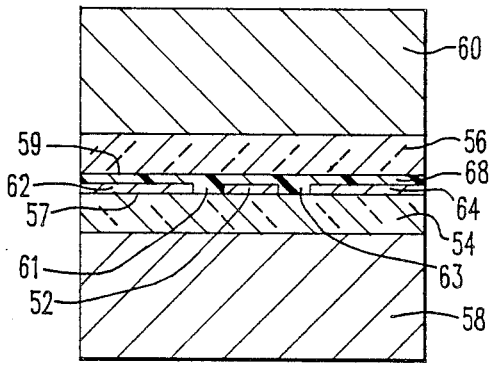

FIGS. 3 and 4E illustrate an FSL device 50 (hereinafter sometimes referred to generally as FSL 50) in accordance with the preferred embodiment of the present invention. The FSL 50 includes a signal-carrying conductor 52 of a predetermined length positioned between a pair of confronting ferrite members 54 and 56. The ferrite members 54 and 56 are yttrium-iron-garnet (YIG) based materials having a generally planar configuration respectively grown on nonmagnetic gadolinium-gallium-garnet (GGG) substrates 58 and 60. In the present invention, GGG substrates 58 and 60 are also utilized to provide mechanical support for the YIG layers 54 and 56. While the second YIG layer 56 provides additional attenuation of the microwave signals carried by the signal-carrying conductor 52, it is not essential to the operation of the FSL in accordance with one embodiment of the present invention (shown in FIG. 4D). In accordance with an embodiment of the present invention, a pair of ground planes 62 and 64 are positioned adjacent to and on each side of signal-carrying conductor 52. The ground planes 62 and 64 generally confine the RF magnetic field 65 produced by microwave signals carried by the signal-carrying conductor 52 within the YIG layers 54 and 56 to a region near one of the confronting surfaces of said YIG layers.

A fully assembled FSL 50 is illustrated in the fragmentary perspective view of FIG. 3. The signal-carrying conductor 52 is positioned between confronting first and second YIG layers 54 and 56. The first and second YIG layers 54 and 56 have a generally planar configuration. The second YIG layer 56 has an overall length less than the overall length of first YIG layer 54. As a result, the end portions 57 (one shown) of the signal-carrying conductor 52 extend outwardly beyond the transverse edge portions 69 (one shown) of the second YIG layer 56. This arrangement allows multiple devices to be connected in series by jumpers and compensation amplifiers (not shown).

Although GGG substrate layers 58 and 60 are illustrated and described herein, other suitable materials may be utilized in forming the substrate layers. The material from which substrate layers 58 and 60 are formed should be selected to have a thermal expansion coefficient (TEC) which approximates that of YIG layers 54 and 56. For example, a high nickel alloy (70% Ni, 17% Mo, 7% Cr, 6% Fe), which has substantially the same TEC of YIG ($\Delta L/L - 10.4\times10^{-6}/°C.$) may be utilized if desired.

FIGS. 4A through 4E illustrate in stepwise fashion the process of forming the FSL 50 shown in FIG. 3. FIG. 4A illustrates the substrate layer 58 which is made of a GGG material. FIG. 4B shows the first YIG layer 54 epitaxially grown on the top surface 55 of substrate 58. The upper or free surface 57 of first YIG layer 54 is metallized with a conductive film 66 (FIG. 4C). Thereafter, as illustrated by FIG. 4D, the metallized film 66 is etched by photolitographic processes to form the signal-carrying conductor 52, as well as the pair of coplanar ground planes 62 and 64. The signal-carrying conductor 52 has a width $W_s$. The ground planes 62 and 64 are separated therefrom by nonconductive gaps 61 and 63 having a width $W_g$. (Alternately the device may be formed by stretching gold wire or ribbon across the YIG layer 54 if desired).

As shown in FIG. 4E, a thin layer of non-conductive epoxy paste 68 is utilized to attach the second YIG layer 56 to the first YIG layer 54 in close contact with the signal-carrying conductor 52 and the coplanar ground planes 62 and 64, thus forming a transverse electromagnetic (TEM) transmission line. (One embodiment of the present invention, shown in FIG. 4D, does not include the second YIG layer 56; as such, the signal-carrying conductor 52 and the coplanar ground planes 62 and 64 form a quasi-transverse electromagnetic transmission line.)

In the FSL 50 of the present invention the transmission line confines the RF magnetic field 65, produced by the signal-carrying conductor 52, to the region near at least one surface 57 and 59 of the respective YIG layers 54 and 56. The ratio of the width $W_s$ to the gap width $W_g$ and the dielectric constant of the YIG material, determines the impedance of the transmission line. For a YIG-based 50 ohm device $W_s$ is also about 0.001 in. and Wg is about 0.001 in.

Figure 5:
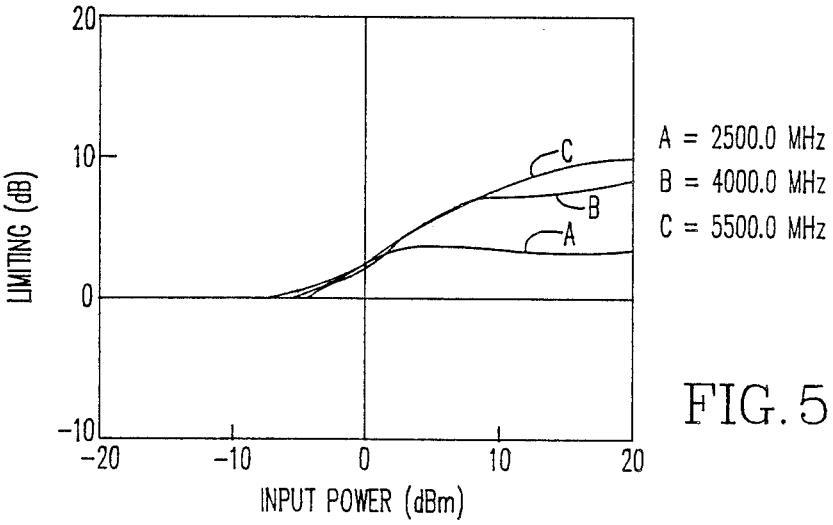
FIG. 5 illustrates graphically the measured limiting of an FSL device according to the embodiment shown in FIGS. 3 and 4E.

FIG. 5 is a plot of the level of attenuation for various frequencies in a one inch long section of a device illustrated in FIG. 3. The limiting threshold, defined as the power at which the insertion loss increased by 1 dB, is about minus 3 dBm (dB above or below one milliwatt) for frequencies between 2.5 and 5.5 GHz. However, up to 10 dB of limiting is achieved at +20 dBm input.

Figure 6:
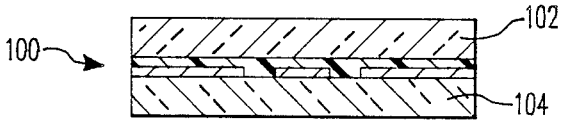
FIG. 6 is a side sectional view of an another embodiment of the present invention in which the GGG layers have been removed.
Figure 7:
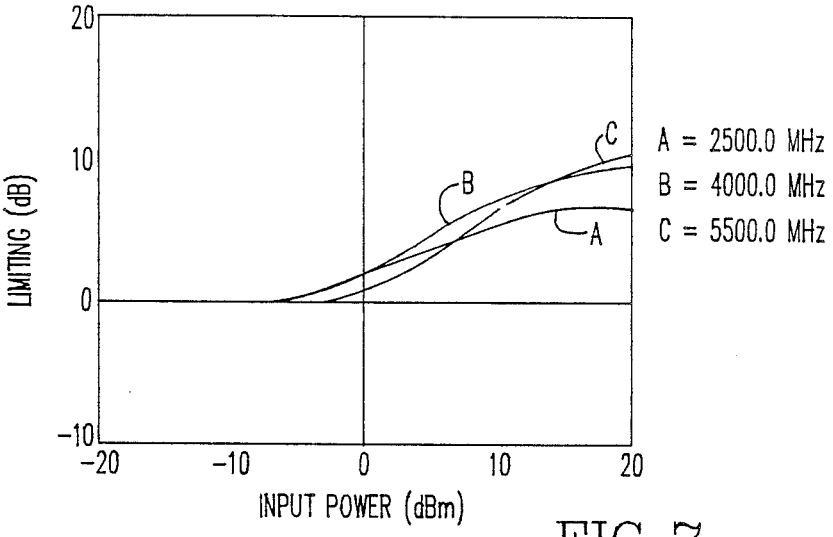
FIG. 7 illustrates graphically the measured limiting of an FSL device according to the embodiment shown in FIG. 6.

The present invention does not require the removal of the GGG material from the YIG layer. However, in some applications the GGG may be removed if desired. FIG. 6 illustrates a device 100 of the present invention in which the GGG has been removed from the YIG layers 102 and 104. FIG. 7 illustrates the measured limiting of the device 100 of FIG. 6. The limiting of devices as shown in FIG. 6 is slightly more uniform for the frequencies noted than in devices where the GGG layers are left in place.

Figure 8:
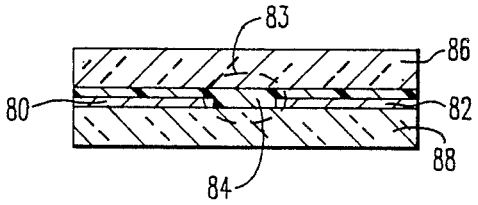
FIG. 8 is a side sectional view of another embodiment of the present invention in the form of a slot line.

Another embodiment of the invention shown in FIG. 8 employs a TE transmission line in the form of a slot line. A pair of coplanar conductors 80 and 82, separated by a narrow gap 84, are sandwiched between two YIG layers 86 and 88. The conductors 80 and 82 may be connected across an RF voltage source (not shown). In the arrangement illustrated, the RF field 83 is confined in the gap 84 near one surface of the YIG layers 86 and 88.

Figure 9:
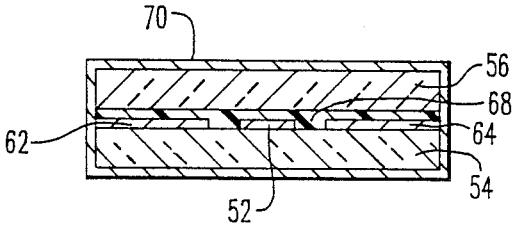
FIG. 9 is a side sectional view of another embodiment of the present invention wherein the GGG layers have been removed and the FSL device is enclosed by an extension of the ground plane between the YIG layers.

FIG. 9 illustrates an embodiment of the present invention wherein the GGG layers 58 and 60 have been removed and the FSL device is enclosed by an extension 70 of the ground planes 62 and 64 between the YIG layers 54 and 56. The outer ground plane 70 maximizes the interaction between the YIG material of layers 54 and 56 and the RF magnetic field lines 65 generated as a microwave signal is carried by the signal-carrying conductors 52.

As stated earlier, the FSL 50 illustrated in FIG. 3 is operable to pass microwave signals therethrough which have a power level below a preselected threshold power level $TP_{in}$, and also to attenuate by a predetermined level those microwave signals having a power level above the preselected threshold power level. The advantages of the FSL 50 described herein over FSLs heretofore utilized lies in the specific construction of the device. Each device attempts to maximize interaction between the YIG material of layers 54 and 56 and the RF magnetic field lines 65 generated as a microwave signal is carried by the signal-carrying conductor 52. The arrangement of the present invention provides a greater level of dB attenuation per unit length of signal-carrying conductors over previously used YIG-based attenuating devices. The present invention incorporates numerous embodiments of a transverse-electromagnetic (TEM) or transverse electric (TE) transmission line between the YIG layers 54 and 56 in order to confine the RF field lines 65 to the YIG material of layers 54 and 56. As stated, the transmission line utilized may include a coplanar waveguide (as shown in FIGS. 3 and 4E) or a slot line (as shown in FIGS. 8 and 9). Each of the aforementioned embodiments of the present invention may be achieved without requiring the laborious, as well as expensive and time consuming, process of grinding the GGG layers from the back of the YIG layers. However, to further enhance the effective limiting of the FSL device, the GGG layers may be removed (as shown in FIG. 6). The entire FSL device may then, if desired, be enclosed by a peripheral ground plane 70 (as shown in FIG. 9). The unique construction of FSL device 50 illustrated in FIGS. 8 and 9 provides a compact, lightweight microwave signal attenuating device which may be used in a variety of microwave signal processing applications.

Although the present invention has been described in terms of what are at present believed to be the preferred embodiments, it will be apparent to those skilled in the art that various changes may be made without departing from the scope of the invention. It is therefore intended that appended claims cover such changes.

What is claimed is:

1. A device for attenuating microwave signals above a preselected power level passed therethrough comprising:

a pair of generally planar confronting ferrite members;

means for magnetically biasing the device with a DC magnetic field normal to the ferrite members; and at least two coplanar closely coupled conductors side by side so as to form a microwave transmission line positioned on one of said ferrite members for carrying the microwave signals on an axis substantially parallel thereto and normal to the DC magnetic field for confining a portion of an RF magnetic field produced by the microwave signals within said ferrite members;

said ferrite members and the DC magnetic field cooperating to attenuate by a predetermined level microwave signals above a preselected threshold power level carried by said signal-carrying conductor.

2. The device according to claim 1 wherein said conductors include a signal carrying conductor positioned between a pair of laterally disposed coplanar ground planes.

3. The device according to claim 2 wherein said coplanar ground planes are in parallel spaced relationship with said signal-carrying conductor.

4. The device according to claim 1 wherein said conductors form a TEM transmission line.

5. The device according to claim 1 wherein said conductors form a quasi-TEM transmission line.

6. The device according to claim 1 wherein the conductors form a coplanar waveguide.

7. The device according to claim 1 wherein said conductors form a slot line.

8. The device according to claim 1 wherein attenuation of the microwave signal having a power level below said preselected threshold power level is substantially zero.

9. The device according to claim 1 wherein said conductors include respective connector end portions.

10. The device according to claim 1 wherein said ferrite members are made from a YIG material.

11. The device according to claim 1 wherein said conductors are made from a gold material.

12. The device according to claim 1 wherein said ferrite members are secured together using a non-conductive epoxy paste.

13. The device according to claim 1 further including a ground plane surrounding the ferrite members in electrical contact with the conductors.

14. The device according to claim 1 wherein at least one of said ferrite members is secured to a supporting substrate.

15. The device according to claim 14 wherein said supporting substrate is a GGG material.

* * * * *